US009241539B1

(12) United States Patent
Keswin

(10) Patent No.: US 9,241,539 B1
(45) Date of Patent: Jan. 26, 2016

(54) SHOELACE TIGHTENING METHOD AND APPARATUS

(71) Applicant: Jeffrey Keswin, New York, NY (US)

(72) Inventor: Jeffrey Keswin, New York, NY (US)

( * ) Notice: Subject to any disclaimer, the term of this patent is extended or adjusted under 35 U.S.C. 154(b) by 122 days.

(21) Appl. No.: 13/925,898

(22) Filed: Jun. 25, 2013

Related U.S. Application Data

(60) Provisional application No. 61/666,054, filed on Jun. 29, 2012.

(51) Int. Cl.
*A43C 7/08* (2006.01)
*A43C 19/00* (2006.01)

(52) U.S. Cl.
CPC ..... *A43C 19/00* (2013.01)

(58) Field of Classification Search
CPC ..... B60P 7/0823; B60P 7/083; B60P 7/0838; A43B 11/00; A43B 3/0005; A43C 11/165; A43C 11/008; Y10T 24/2183
USPC ..... 24/712.5, 712.4, 713.5; 36/50.1, 83
See application file for complete search history.

(56) References Cited

U.S. PATENT DOCUMENTS 2,315,196 A * 3/1943 Gallione ..... 248/499
3,197,155 A 7/1965 Chow
3,564,670 A * 2/1971 Bengtsson ..... 403/390
4,741,115 A * 5/1988 Pozzobon ..... A43B 5/0433 24/68 SK
4,766,835 A * 8/1988 Randall et al. ..... 114/218
4,899,423 A * 2/1990 Randall ..... 24/134 R
5,477,593 A * 12/1995 Leick ..... 24/712.5
5,572,777 A 11/1996 Shelton
5,924,178 A 7/1999 Holmberg
6,032,387 A * 3/2000 Johnson ..... A43C 1/06 36/118.1
6,278,378 B1 8/2001 Feiner et al.
6,339,867 B1 * 1/2002 Azam ..... 24/712.5
6,427,361 B1 * 8/2002 Chou ..... A43B 11/00 36/138
6,467,194 B1 10/2002 Johnson
6,510,627 B1 1/2003 Liu
6,691,433 B2 * 2/2004 Liu ..... A43B 3/0005 24/68 SK
6,775,928 B2 * 8/2004 Grande et al. ..... 36/50.1
6,807,754 B2 10/2004 Miller et al.
6,808,462 B2 10/2004 Snyder et al.
6,896,128 B1 * 5/2005 Johnson ..... A43C 1/06 36/118.1
7,082,701 B2 8/2006 Dalgaard et al.
7,360,282 B2 * 4/2008 Borsoi ..... 24/136 R
7,457,724 B2 * 11/2008 Vock et al. ..... 702/182
7,503,131 B2 * 3/2009 Nadel ..... A43B 5/0415 36/117.1
7,579,946 B2 8/2009 Case, Jr.
7,751,832 B2 7/2010 Bartkowski (Continued)

FOREIGN PATENT DOCUMENTS

EP 1336348 8/2003
EP 1352580 10/2003

(Continued)

*Primary Examiner* — Robert J Sandy
*Assistant Examiner* — Rowland Do
(74) *Attorney, Agent, or Firm* — Faegre Baker Daniels LLP

(57) ABSTRACT

A method is disclosed for tightening laces of an article of clothing. The method may include the steps of receiving an input code; determining if the input code matches a stored code; and if the input code matches the stored code, actuating a tightening device to tighten the laces. A system is disclosed for tightening laces of an article of clothing. The system may include a controller and a tightening device configured to engage the laces. The tightening device may be operatively coupled to the controller. The controller may place the tightening device in one of a plurality of configurations.

11 Claims, 3 Drawing Sheets

(56) References Cited

U.S. PATENT DOCUMENTS

| | | | | |
|---|---|---|---|---|
| 7,752,774 | B2 * | 7/2010 | Ussher | A43B 3/0005 36/100 |
| 7,946,007 | B2 * | 5/2011 | Borsoi | 24/712.5 |
| 7,958,654 | B2 | 6/2011 | Reagan et al. | |
| 8,015,732 | B2 | 9/2011 | Berner, Jr. et al. | |
| 8,046,937 | B2 * | 11/2011 | Beers | A43B 3/0005 24/68 SK |
| 8,258,941 | B2 | 9/2012 | Case, Jr. | |
| 8,277,401 | B2 | 10/2012 | Hammerslag et al. | |
| 8,360,904 | B2 | 1/2013 | Oleson et al. | |
| 8,371,004 | B2 | 2/2013 | Huber et al. | |
| 8,516,662 | B2 * | 8/2013 | Goodman et al. | 24/68 SK |
| 8,935,860 | B2 * | 1/2015 | Torres | A43B 3/0005 36/138 |
| 2004/0243392 | A1 * | 12/2004 | Chino et al. | 704/7 |
| 2005/0198867 | A1 * | 9/2005 | Labbe | A43B 11/00 36/50.1 |
| 2005/0256720 | A1 * | 11/2005 | Iorio | 704/275 |
| 2005/0273988 | A1 | 12/2005 | Christy | |
| 2007/0080518 | A1 * | 4/2007 | Carvajal | 280/611 |
| 2008/0086911 | A1 * | 4/2008 | Labbe | A43B 11/00 36/50.1 |
| 2009/0192759 | A1 | 7/2009 | Wedge | |
| 2009/0272007 | A1 * | 11/2009 | Beers et al. | 36/50.1 |
| 2011/0199393 | A1 * | 8/2011 | Nurse | A43B 3/00 345/665 |
| 2012/0246023 | A1 | 9/2012 | Starr | |
| 2013/0031808 | A1 | 2/2013 | Holness | |
| 2013/0272814 | A1 * | 10/2013 | Villalon-Regalado | B60P 7/083 410/103 |

FOREIGN PATENT DOCUMENTS

| | | |
|---|---|---|
| EP | 1440627 | 3/2006 |
| WO | WO 96/21372 | 7/1996 |
| WO | WO 2010/087534 | 8/2010 |
| WO | WO 2011/081261 | 7/2011 |

* cited by examiner

SHOELACE TIGHTENING METHOD AND APPARATUS

RELATED APPLICATIONS

This application claims the benefit of U.S. Provisional Application Ser. No. 61/666,054, filed Jun. 29, 2012, titled SHOELACE TIGHTENING METHOD AND APPARATUS, the disclosure of which is expressly incorporated by reference herein.

FIELD

The present invention is directed to methods and apparatus to tighten the laces of an article of clothing and more particularly to methods and apparatus to tighten the laces of an article of clothing in response to an audio input.

BACKGROUND

Shoelaces often become untied when not desired. Shoelaces may be tightened manually. This involves leaning over or raising the foot to permit the hands to actuate the laces. A need exists for a system and method to permit the laces of a shoe to be tightened without manual actuation by the hands.

SUMMARY

In an exemplary embodiment of the present disclosure, a system for tightening laces of an article of clothing is provided. The system comprising a controller, a first user input device operatively coupled to the controller, and a tightening device configured to engage the laces. The tightening device being operatively coupled to the controller. The controller places the tightening device in one of a plurality of configurations, an engaged configuration restraining a free movement of the laces and a disengaged configuration permitting the free movement of the laces. In response to the first user input device receiving a first audio user input, the controller places the tightening device in the engaged configuration.

In one example, in response to the first user input device receiving the first user input, the controller further causes the laces to be tightened.

In another example, the first user input is a audio code. In a variation thereof, the laces are tightened for a predetermined time period. In another variation thereof, the laces are tightened to a predetermined tension. In a further variation thereof, the laces are tightened until a second user input is received by the first user input device.

In a further example, the first user input device is a microphone and the first audio user input is an audio code.

In still another example, the tightening device includes a frame having a pair of conduits extending therethrough, each of the pair of conduits being adapted to receive a respective lace; a motor supported by the frame; and a pair of tighteners supported by the frame and operatively coupled to the motor, each of the pair of tighteners being adpated to engage the respective lace to tighten the respective lace when the tightening device is in the engaged configuration. In a variation thereof, the pair of tighteners are spaced apart from the laces when the tightening device is in the disengaged configuration. In another variation thereof, the pair of tighteners are rotated by the motor to tighten the laces when the tightening device is in the engaged configuration.

In yet another example, the system further comprises a second user input operatively coupled to one of the controller and the tightening device, wherein in response to the second user input device receiving a second user input one of the controller and the tightening device places the tightening device in the disengaged configuration In another exemplary embodiment of the present disclosure, a method for tightening laces of an article of clothing. The method comprising the steps of receiving an input code, determining if the input code matches a stored code, and if the input code matches the stored code, actuating a tightening device to tighten the laces. In one example, the article of clothing is a shoe.

In still another exemplary embodiment of the present disclosure, a method for tightening laces of an article of clothing. The method comprising the steps of coupling a tightening device to the laces, receiving an audible input code, determining if the input code matches a stored code; and if the input code matches the stored code, actuating the tightening device to tighten the laces. In one example, the step of coupling the tightening device to the laces includes the steps of routing a first lace through a first conduit of the tightening device; and routing a second lace through a second conduit of the tightening device.

The above and other features of the present disclosure, which alone or in any combination may comprise patentable subject matter, will become apparent from the following description and the attached drawings.

BRIEF DESCRIPTION OF THE DRAWINGS

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION OF THE DRAWINGS

The embodiments disclosed herein are not intended to be exhaustive or limit the invention to the precise form disclosed in the following detailed description. Rather, the embodiment is chosen and described so that others skilled in the art may utilize its teachings.

Figure 1:
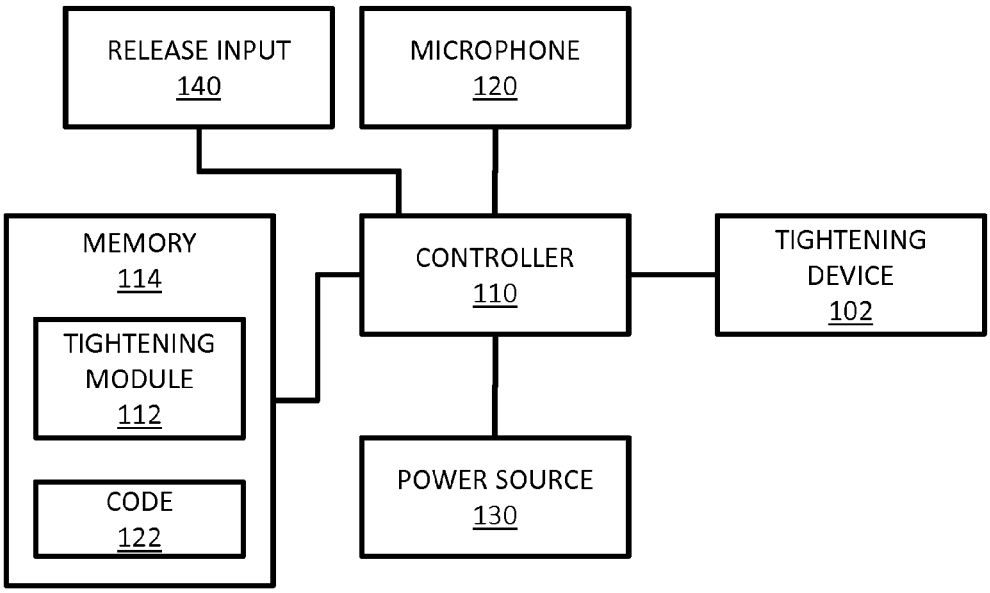
FIG. 1 illustrates an exemplary shoe tightening apparatus.

Referring to FIG. 1, a shoe tightening system 100 for use with a shoe 10 is shown. Shoe tightening system 100 includes a tightening device 102 which engages the laces 104 (see FIG. 2) of a shoe 10 to tighten the laces. The tightening device may be arranged in a disengaged configuration permitting the laces 104 to move freely and an engaged configuration restraining the free movement of the laces 104.

The tightening device 102 is operatively coupled to a controller 110 which controls the operation of tightening device 102. Controller 110, in one embodiment, is processing device which executes logic to control the operation of tightening device 102. In the illustrated embodiment, the logic is a tightening module 112 stored on a memory 114 accessible by the controller 110. In one embodiment, the logic is provided through hardware, software, or a combination of hardware and software.

Shoe tightening system 100 further includes a user input device, illustratively a microphone 120. Other exemplary user input devices may be provided including one or more of a touch screen, a switch, a lever, a button, a sensor, and other devices to provide an input to controller 110.

In one embodiment, the tightening module 112 being executed by controller 110 monitors microphone 120 for the receipt of an input code which matches a code 122 which is stored on memory 114. Code 122 may be selected by the user, recorded by the user, or preset. In one embodiment, code 122 may be recorded by the user. An exemplary code 122 is "Tie my shoes, Mitch!"

Tightening module 112 includes a processing sequence wherein when microphone 120 receives audio matching code 122, tightening module 112 causes tightening device 102 to be placed in an engaged configuration and tighten laces 104. In one embodiment, the laces 104 are tightened for a predetermined time. In one embodiment, the laces 104 are tightened until a predetermined tension is reached. In one embodiment, the laces 104 are tightened until the code 122 is received again by microphone 120. In one embodiment, a release input 140 is provided which signals tightening module 112 to place tightening device 102 in the disengaged configuration. An exemplary release input 140 is a button. In one embodiment, release input 140 engages tightening device 102 directly to place tightening device 102 in the disengaged configuration.

Shoe tightening system 100 is powered by a power source 130 which provides power to both tightening device 102 and controller 110. An exemplary power source 130 is a battery system.

Figure 2:
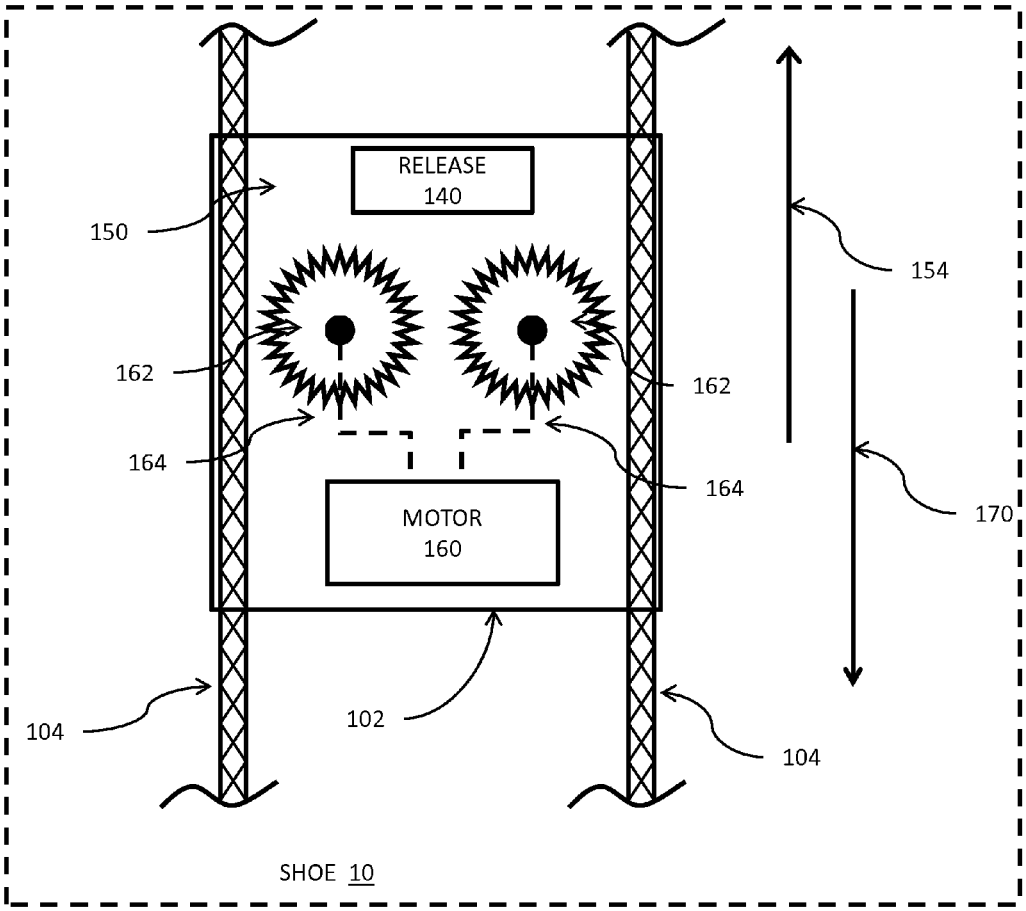
FIG. 2 illustrates an exemplary embodiment of the shoe tightening apparatus in a disengaged configuration.
Figure 2A:
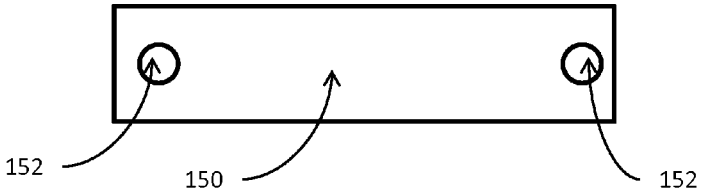
FIG. 2A illustrates a top view of the shoe tightening apparatus of FIG. 2.
Figure 3:
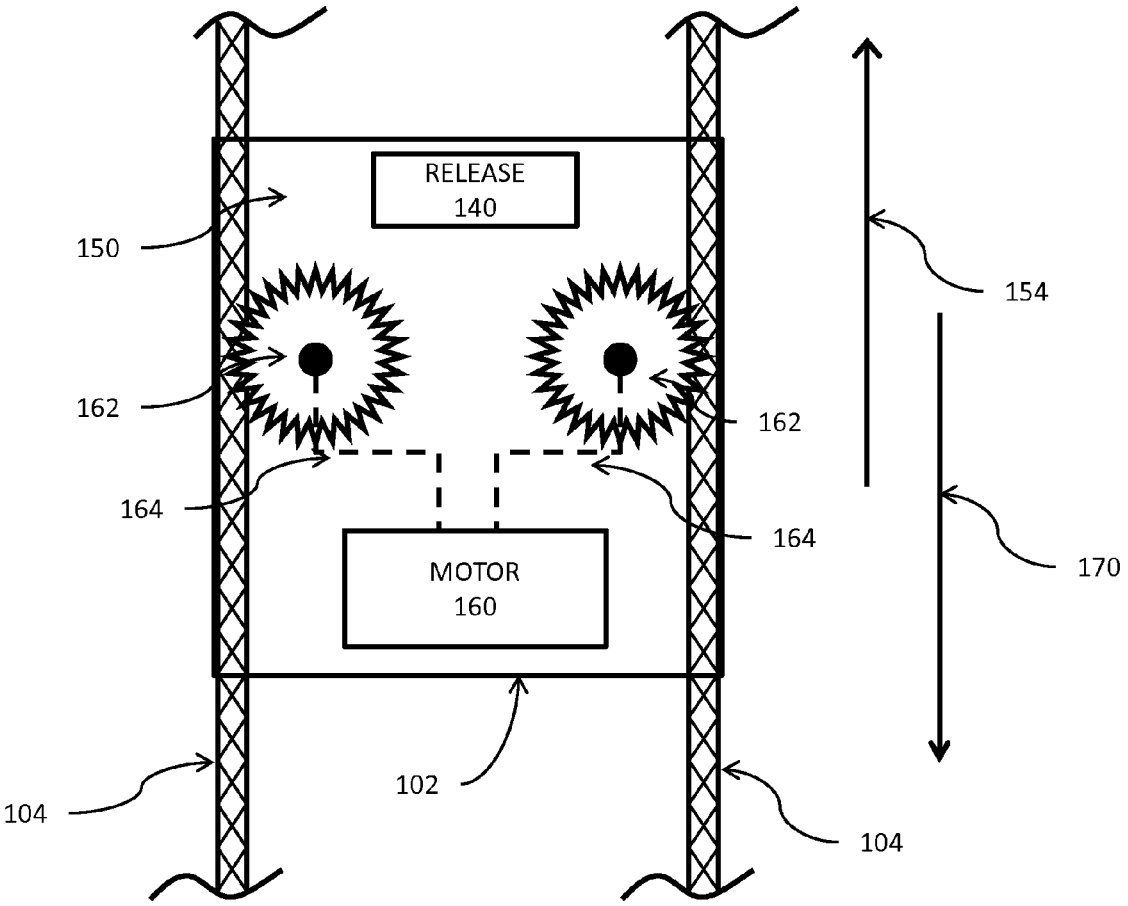
FIG. 3 illustrates the embodiment of FIG. 2 is an engaged configuration.

Referring to FIG. 2, an exemplary embodiment of shoe tightening system 100 is shown. Tightening device 102 is shown and includes a frame 150 having a pair of conduits 152 extending there through. Laces 104 are routed through conduits 152 in direction 154. Tightening device 102 includes a motor 160 coupled to a pair of tighteners 162 through respective coupling members 164. Motor 160, tighteners 162, and coupling members 164 are supported by frame 150. In FIG. 2, tighteners 162 are shown spaced apart from laces 104 and are in a disengaged configuration. Referring to FIG. 3, tighteners 162 are shown contacting laces 104 and are in an engaged configuration. The coupling members 164 move tighteners 162 relative to laces 104. In the engaged configuration, tighteners 162 restrain laces 104 from moving in direction 170. This keeps the laces 104 tightened. When the code 122 is received by controller 110, tighteners 162 are rotated to advance laces 104 in direction 154 and further tighten laces 104. When release input 140 is pressed, tighteners 162 are returned to the disengaged configuration of FIG. 2.

The movement of tighteners 162 are carried out by motor 160 and coupling members 164 are known in the art. Although the illustrated embodiment discusses tightening the laces of shoes, the tightening system 100 may be used to tighten other articles of clothing.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A system for tightening laces of an article of clothing, the system comprising:

a controller; a first user input device operatively coupled to the controller; a tightening device including a conduit sized and configured to receive at least one lace, the tightening device being operatively coupled to the controller, wherein the controller places the tightening device in one of a plurality of configurations including an engaged configuration and a disengaged configuration, wherein the tightening device comprises:

a frame having a pair of the conduits extending therethrough, each of the pair of conduits being sized and configured to receive a respective lace;

a motor supported by the frame; and a pair of tighteners supported by the frame and operatively coupled to the motor, each of the pair of tighteners being adapted to engage the respective lace such that actuation of the motor drives the pair of tighteners in a manner adapted to tighten the respective lace when the tightening device is in the engaged configuration, the pair of tighteners being rotated by the motor when the motor is actuated such that the pair of tighteners are adapted to tighten the laces when the tightening device is in the engaged configuration;

the conduit being restricted to a first size in the engaged configuration, the first size dimensioned to restrain a free movement of the laces the at least one lace, and the conduit being opened to a second size in the disengaged configuration, the second size dimensioned to permit the free movement of the at least one lace, wherein in response to the first user input device receiving a first audio user input the controller places the tightening device in the engaged configuration.

2. The system of claim 1 in combination with at least one lace received in the conduit, wherein in response to the first user input device receiving the first user input, the controller further causes the at least one lace to be tightened.

3. The system of claim 2, wherein the at least one lace is tightened for a predetermined time period.

4. The system of claim 2, wherein the at least one lace is tightened to a predetermined tension.

5. The system of claim 2, wherein the at least one lace is tightened until a second user input is received by the first user input device.

6. The system of claim 1, wherein the first user input is an audio code.

7. The system of claim 1, wherein the first user input device is a microphone and the first audio user input is an audio code.

8. The system of claim 1, wherein the pair of tighteners are spaced apart from the conduits when the tightening device is in the disengaged configuration.

9. The system of claim 1, further comprising a second user input operatively coupled to one of the controller and the tightening device, wherein in response to the second user input device receiving the second user input one of the controller and the tightening device places the tightening device in the disengaged configuration.

10. The system of claim 1, further comprising:

a release input operatively coupled to one of the controller and the tightening device, wherein in response to actuation of the release input, one of the controller and the tightening device places the tightening device in the disengaged configuration, the pair of tighteners being spaced apart from the conduits when the tightening device is in the disengaged configuration.

11. The system of claim 10, wherein the conduits are disposed along lateral edges of the frame, and the motor and the pair of tighteners are supported by the frame and disposed between the conduits.

* * * * *